US009854365B2

(12) United States Patent
Sterling

(10) Patent No.: US 9,854,365 B2
(45) Date of Patent: Dec. 26, 2017

(54) LOUDSPEAKER MOTOR AND SUSPENSION SYSTEM

(71) Applicant: Harman International Industries, Inc., Stamford, CT (US)

(72) Inventor: Brian Sterling, Farmington Hills, MI (US)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 15/130,044

(22) Filed: Apr. 15, 2016

(65) Prior Publication Data

US 2017/0303044 A1 Oct. 19, 2017

(51) Int. Cl.

| | |
|---|---|
| ***H04R 9/06*** | (2006.01) |
| ***H04R 7/18*** | (2006.01) |
| ***H04R 9/02*** | (2006.01) |
| ***H04R 9/04*** | (2006.01) |
| ***H04R 7/16*** | (2006.01) |

(52) U.S. Cl.

CPC ..... *H04R 7/18* (2013.01); *H04R 7/16* (2013.01); *H04R 9/025* (2013.01); *H04R 9/04* (2013.01); *H04R 9/045* (2013.01); *H04R 9/06* (2013.01); *H04R 2209/041* (2013.01); *H04R 2400/07* (2013.01)

(58) Field of Classification Search

CPC . H04R 7/18; H04R 7/20; H04R 9/025; H04R 9/04; H04R 9/045; H04R 9/046; H04R 9/06; H04R 9/063; H04R 2209/041; H04R 2209/043; H04R 2400/07; H04R 7/16

USPC ..... 381/396, 398, 400, 401, 403, 404, 405, 381/407, 412, 418, 420, 432; 181/171, 181/172, 199

See application file for complete search history.

(56) References Cited

U.S. PATENT DOCUMENTS

| | | | | |
|---|---|---|---|---|
| 4,190,746 | A * | 2/1980 | Harwood | H04R 7/02 181/167 |
| 5,142,260 | A | 8/1992 | House | |
| 5,748,760 | A | 5/1998 | Button | |
| 5,828,767 | A | 10/1998 | Button | |

(Continued)

FOREIGN PATENT DOCUMENTS

EP 0581129 A1 2/1994

OTHER PUBLICATIONS

JBL Professional, "JBL's Differential Drive® Transducers.", JBL Technical Notes vol. 1 No. 33 (Jun. 2005) http://www.jblpro.com/ProductAttachments/technote V1 n 33.pdf) (8 pages).

(Continued)

*Primary Examiner* — Huyen D Le
(74) *Attorney, Agent, or Firm* — Adam West; Brooks Kushman P.C.

(57) ABSTRACT

A loudspeaker includes a voice coil in a balanced state. In the loudspeaker, at least a first suspension element acts on a first side of the voice coil, and at least a second suspension element acts on a second side of the voice coil. The loudspeaker includes a symmetric magnet assembly. The voice coil aligns with the symmetric magnet assembly. The symmetric alignment contributes to the loudspeaker yielding substantially symmetric motor force (BL), suspension stiffness (K), and inductance (Le).

24 Claims, 10 Drawing Sheets

(56) References Cited

U.S. PATENT DOCUMENTS

| | | | | |
|---|---|---|---|---|
| 6,490,363 | B1 * | 12/2002 | Liu | H04R 9/06 381/398 |
| 6,526,151 | B1 * | 2/2003 | Peng | H04R 9/06 181/171 |
| 6,654,476 | B1 * | 11/2003 | Guenther | H04R 1/06 381/407 |
| 6,768,806 | B1 | 7/2004 | Button et al. | |
| 6,774,510 | B1 | 8/2004 | Moro et al. | |
| 7,856,115 | B2 * | 12/2010 | Clair | H04R 1/403 381/398 |
| 8,259,986 | B2 | 9/2012 | Danovi et al. | |
| 8,891,809 | B2 | 11/2014 | Danovi | |
| 9,485,587 | B1 * | 11/2016 | Skramstad | H04R 9/046 |

OTHER PUBLICATIONS

W. Klippel, "Tutorial: Loudspeaker Nonlinearities—Causes, Parameters, Symptoms" J. Audio Eng. Soc., vol. 54, No. 10, pp. 907-939 (Oct. 2006)(http://www.aes.or/e-lib/browse.cfm?elib=13881).

D. Button, Heat Dissipation and Power Compression in Loudspeakers, J. Audio Eng. Soc., vol. 40, No. 1/2, pp. 32-41 (Jan. 1992)(http://www.aes.org/e-lib/browse.cfm?elib=7059).

PCT International Search Report and Written Opinion dated May 8, 2017 for PCT/US17/27362.

* cited by examiner

LOUDSPEAKER MOTOR AND SUSPENSION SYSTEM

TECHNICAL FIELD

Embodiments disclosed herein generally relate to loudspeaker motor and suspension systems.

BACKGROUND

A conventional loudspeaker includes a single suspension region. The single suspension region places a voice coil in an unbalanced state. The unbalanced state occurs because the single suspension region acts on one side of the voice coil. Additionally, the conventional loudspeaker includes an asymmetric motor region. In the asymmetric motor region, the motor geometry around the voice coil is not symmetric. The unbalanced state and the asymmetric motor region lead to significant asymmetrical motor force (BL), significant asymmetrical suspension stiffness (K), and significant asymmetrical inductance (Le). The aforementioned, thus, makes the conventional loudspeaker prone to non-linear distortion, instability, and other acoustical performance issues.

SUMMARY

In one embodiment, a loudspeaker is provided with a magnet assembly that is aligned along a longitudinal axis. A frame encircles the magnet assembly about the longitudinal axis. The magnet assembly and the frame form a voice coil gap therebetween. The voice coil is disposed in the voice coil gap and is mounted for translation along the longitudinal axis. Moreover, the voice coil includes a first side that is longitudinally spaced from a second side. A voice coil former is attached to the voice coil. A diaphragm is attached to the voice coil former. The diaphragm is adjacent to the first side of the voice coil. A first suspension element is attached to both the diaphragm and the frame. The first suspension element acts on/supports the first side during translation of the voice coil. A second suspension element is attached to both the voice coil former and the frame. The second suspension element is adjacent to the second side. The second suspension element acts on/supports the second side during translation of the voice coil.

In another embodiment, a loudspeaker is provided with a magnet assembly that is aligned along a longitudinal axis. A frame encircles the magnet assembly about the longitudinal axis. The frame includes an outer wall. The magnet assembly and the outer wall form a voice coil gap. A voice coil is disposed in the voice coil gap. The voice coil is aligned in the voice coil gap to yield at least two of the following: a substantially symmetric motor force, a substantially symmetric suspension stiffness, and/or a substantially symmetric inductance.

In another embodiment, a loudspeaker is provided with a magnet assembly that is aligned along a longitudinal axis. A frame encircles the magnet assembly about the longitudinal axis. The magnet assembly and the frame form a voice coil gap. A voice coil is disposed in the voice coil gap. The voice coil includes a first side longitudinally spaced from a second side. A first suspension region extends from the first side of the voice coil and transversely to the longitudinal axis. The first suspension region includes a first suspension element attached to both the frame and the first side of the voice coil. A second suspension region is longitudinally separated from the first suspension region. The second suspension region extends from the second side of the voice coil and transversely to the longitudinal axis. And the second suspension region includes a second suspension element that is attached to both the frame and the second side of the voice coil.

As such, compared to the conventional loudspeaker, the embodiments herein allow for balanced voice coils, as well as substantially symmetric motor force, substantially symmetric suspension stiffness, and substantially symmetric inductance.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
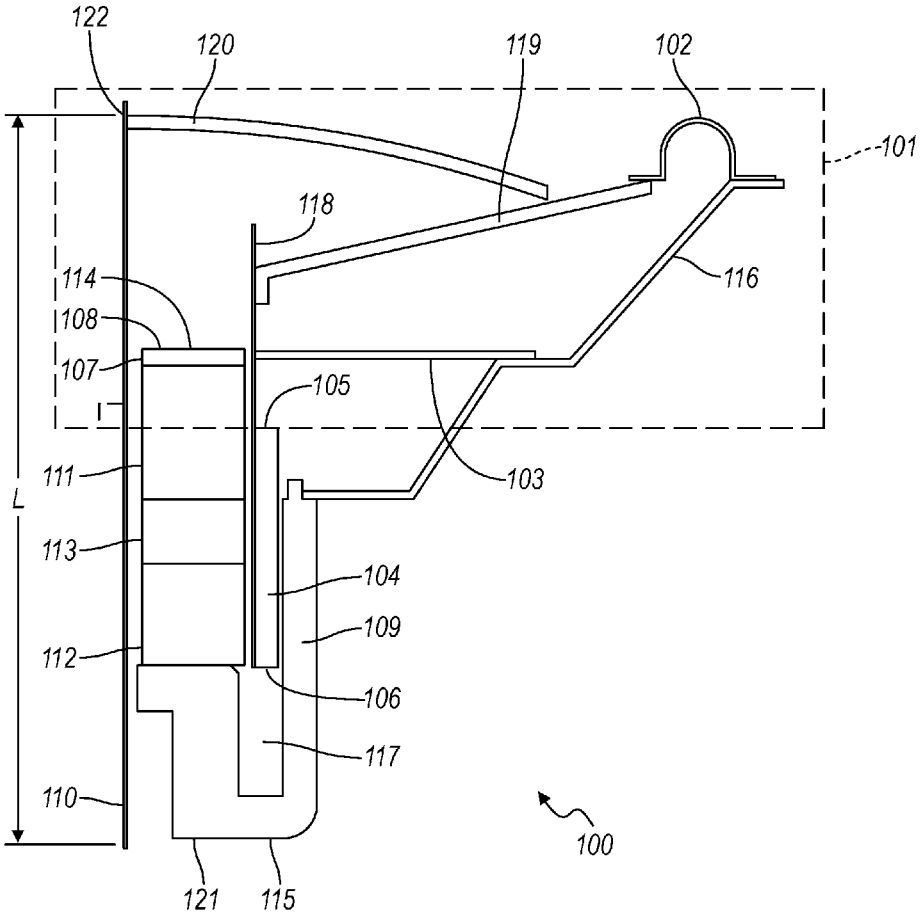
FIG. 1 (prior art)
FIG. 1 is a partial section view of a prior-art conventional loudspeaker.

FIG. 1 illustrates a partial section view of a conventional loudspeaker, which is in accordance with the prior-art and is generally referenced by numeral 100. The conventional loudspeaker 100 includes a single suspension region 101. The single suspension region 101 includes a first suspension element 102 and a second suspension element 103. The single suspension region 101 places a voice coil 104 of the conventional loudspeaker 100 in an unbalanced state.

In the unbalanced state, the single suspension region 101 acts on a first side 105 of the voice coil 104. More specifically, the first suspension element 102 and the second suspension element 103 act on the first side 105 of the voice coil 104. Alternatively stated, the first suspension element 102 and the second suspension element 103 support the first side 105 of the voice coil 104. The voice coil 104 includes a second side 106 that is longitudinally spaced from the first side 105. Because of the single suspension region 101, though, the application of stiffness/support is one-sided. The one-sided application of stiffness/support occurs because the first suspension element 102 and the second suspension element 103 both act on the first side 105 of the voice coil 104. In the conventional loudspeaker 100, there is not an additional suspension element that acts on the second side 106 of the voice coil 104 to complement the stiffness/support effects of the first suspension element 102 and the second suspension element 103. Because of that, the voice coil 104 is in the unbalanced state.

In the conventional loudspeaker 100, the unbalanced state is acoustically undesirable. For example, the unbalanced state is likely to cause rocking, midband rubs, extraneous noise, permanent damage, or outright failure.

The conventional loudspeaker 100 includes an asymmetric motor region 107. In the asymmetric motor region 107, the voice coil 104 asymmetrically aligns with a magnet assembly 108. Moreover, in the asymmetric motor region, the conventional loudspeaker 100 includes a motor geometry 109 around the voice coil 104 that is not symmetric. The motor geometry 109 is such that there is more material (e.g., low carbon steel) around the second side 106 of the voice coil 104 than the first side 105. The motor geometry results in significant acoustical parameter asymmetry for motor force (BL), suspension stiffness (K), and inductance (Le). Therefore, in the conventional loudspeaker 100, the motor force, the suspension stiffness, and the inductance are not substantially symmetric.

In the conventional loudspeaker 100, the significantly asymmetric motor force, suspension stiffness, and inductance are acoustically undesirable. For example, the significantly asymmetric motor force, suspension stiffness, and inductance are likely to cause nonlinear distortion, instability, etc.

The conventional loudspeaker 100 aligns along a longitudinal axis 110. Therefore, the magnet assembly 108 aligns along the longitudinal axis 110. The magnet assembly 108 includes a first magnet 111 and a second magnet 112. A spacer 113 separates the first magnet 111 from the second magnet 112. In addition to the spacer 113, the first magnet 111 attaches to an end cap 114.

In addition to the spacer 113, the second magnet 112 attaches to a back cover 115. The back cover 115 attaches to a basket 116. The basket 116 extends from the back cover into the single suspension region 101. The single suspension region 101 extends longitudinally from the first side 105 of the voice coil 104 and transversely from the longitudinal axis 110. Additionally, the back cover 115 and the magnet assembly 108 form a voice coil gap 117. The voice coil 104 resides in the voice coil gap 117. (I.e., the voice coil 104 is disposed in the voice coil gap 117.) The voice coil 104 attaches to a voice coil former 118. The voice coil former 118 attaches to a diaphragm 119. A dust cap 120 attaches to the diaphragm 119. Furthermore, in the conventional loudspeaker 100, the first suspension element 102 attaches to the basket 116 and the diaphragm 119. And the second suspension element 103 attaches to the basket 116 and the voice coil former 118.

Because of the unbalanced state, the voice coil 104 is prone to misalignment issues in the voice coil gap 117. For example, transversely to the longitudinal axis, the spacing between the back cover 115 and the voice coil 104 at the first side 105 in the voice coil gap 117 may be significantly different than the spacing between the back cover 115 and the voice coil 104 at the second side 106 in the voice coil gap 117. Because of the unbalanced state, the voice coil 104 is particularly vulnerable to varying the transverse spacing at the second side 106. Alternatively stated, because of the unbalanced state, the second side 106 is more prone to movement in a direction that is transverse to the longitudinal axis 110. This may be exacerbated when the voice coil 104 translates along the longitudinal axis 110. While translation along the longitudinal axis 110 is expected during normal operation, significant movement in the transverse direction (which the voice coil 104 is prone to) yields undesirable consequences, such as the aforementioned rocking, midband rubs, extraneous noise, etc.

In the conventional loudspeaker 100, the asymmetric motor region 107 includes the magnet assembly 108, the back cover 115, and the voice coil 104. Additionally, the asymmetric motor region 107 includes at least a portion of the basket 116. The magnet assembly 108, the back cover 115, and the portion of the basket 116 define the motor geometry 109 around the voice coil 104. In the conventional loudspeaker 100, the back cover 115 forms part of a magnetic flux flow loop through the voice coil 104. This is because the back cover 115 is made out of low carbon steel or a comparable material. The spacer 113, the end cap 114, and the basket 116 may be made out of the same material as the back cover 115.

Additionally, the conventional loudspeaker 100 includes an overall length L along the longitudinal axis 110. The overall length L runs from a backside 121 of the back cover 115 to a point 122 that is distally located in the single suspension region 101. The point 122 corresponds to the dust cap 120, the first suspension element 102, or the basket 116—whichever is most distally located from the backside 121 along the longitudinal axis 110. Along the longitudinal axis 110, the point 122 is farthest from the backside 121 of the back cover 115.

In order to increase the overall motor force of the conventional loudspeaker 100, the overall length L generally needs to increase. In general, to increase the overall motor force, the length of the magnet assembly 108 needs to be increased (by the introduction of longer and/or additional magnets or other components therein), the length of the voice coil 104 needs to be increased (such as by increasing the number of turns along the longitudinal axis) or at least one or more additional voice coils needs to be introduced, or a combination of the aforementioned needs to occur. Often, through the aforementioned, the overall length L of the conventional loudspeaker 100 needs to be increased. That is often the case when there is not enough room in the conventional loudspeaker 100 to increase the length of the magnet assembly 108, increase the length of the voice coil 104, or add additional voice coils.

Increasing the overall length L of the conventional loudspeaker 100 may be impractical in a shallow-depth environment, such as between two walls of a listening room, between a first surface and a second surface of an automobile door, under a seat bottom and a floor pan of an automobile, etc. The shallow-depth environment may include a design constraint such that the overall length L of the conventional loudspeaker 100 must be less than or equal to a shallow-depth. If the overall length is equal to the shallow-depth, the overall motor force of the conventional loudspeaker 100 may be maxed out.

Figure 2:
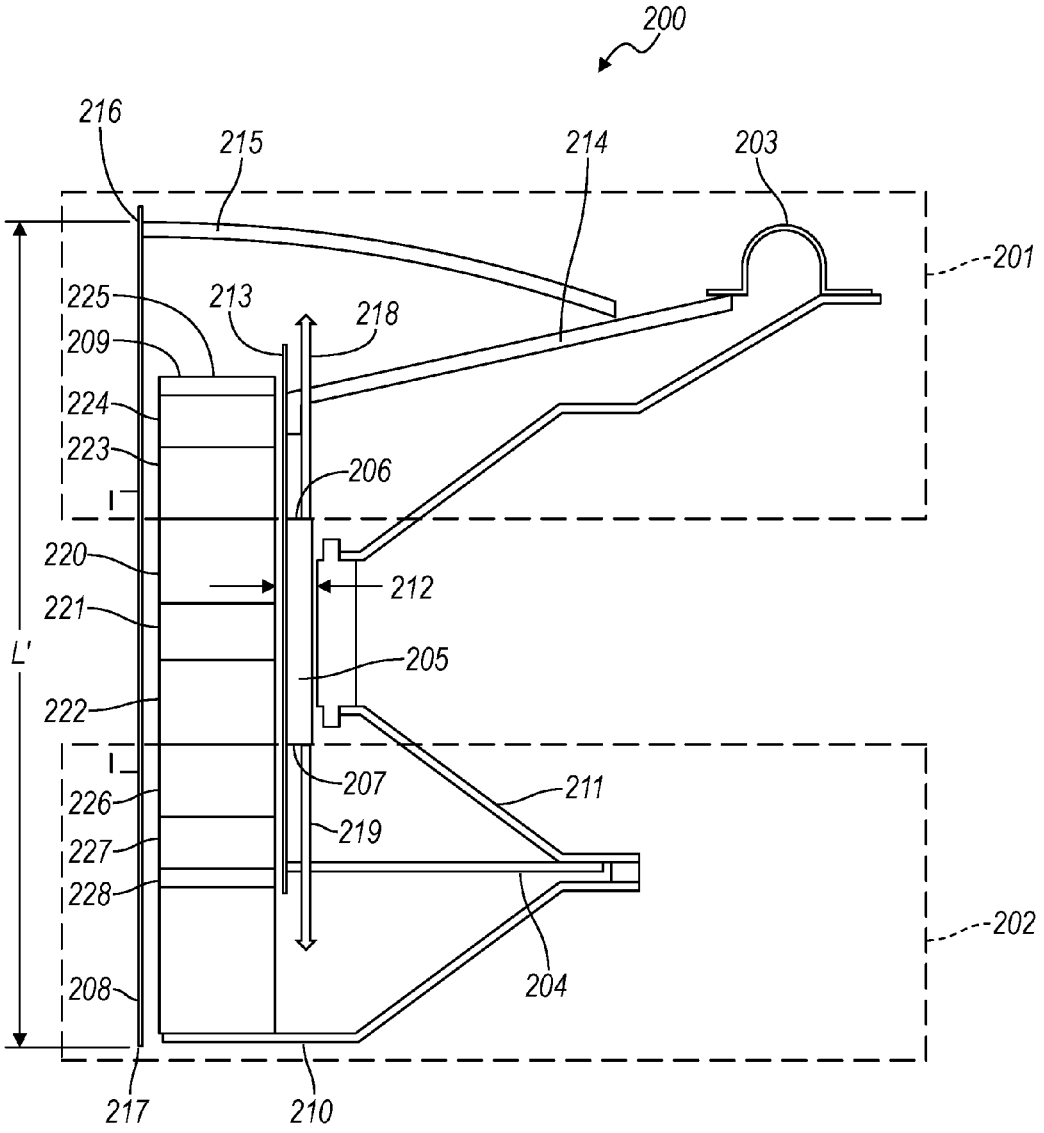
FIG. 2 is a partial section view of a loudspeaker according to one or more embodiments.
Figure 3:
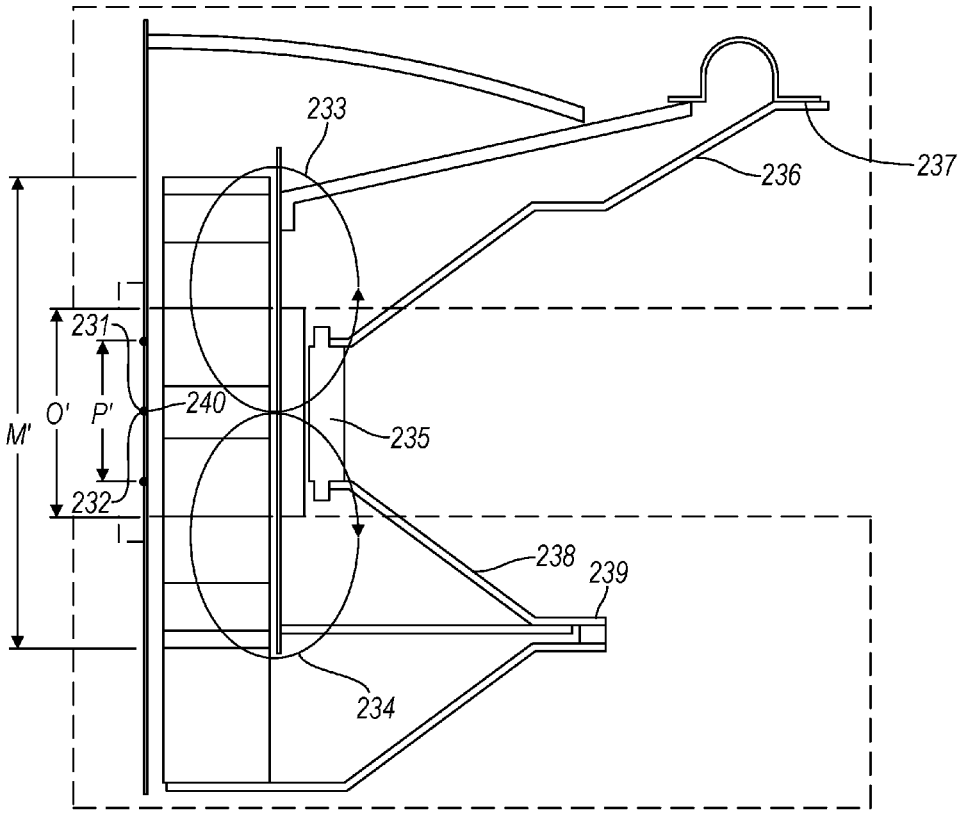
FIG. 3 illustrates magnetic flux flow loops on the loudspeaker of the partial section view from FIG. 2.

FIGS. 2 and 3 illustrate partial section views of a loudspeaker 200, which is in accordance with one or more embodiments of the present invention. The loudspeaker 200 includes a first suspension region 201 and a second suspension region 202. The first suspension region 201 includes a first suspension element 203. The second suspension region 202 includes a second suspension element 204.

The first suspension region 201 and the second suspension region 202 place a voice coil 205 in a balanced state. More specifically, the first suspension element 203 acts on a first side 206 of the voice coil 205. The first side 206 is longitudinally spaced from a second side 207 of the voice coil 205. The second suspension element 204 acts on the second side 207 of the voice coil 205. Alternatively stated, the first suspension element 203 supports the first side 206 of the voice coil 205, and the second suspension element 204 supports the second side 207 of the voice coil 205. Because of the way that the first suspension element 203 and the second suspension element 204 act on the first side 206 and the second side 207, the voice coil 205 is in the balanced state. The balanced state is thus achieved because at least one suspension element (i.e., the first suspension element 203) acts on the first side 206 of the voice coil 205, and at least one other suspension element (i.e., the second suspension element 204) acts on the second side 207 of the voice coil 205.

In the balanced state, the first suspension element 203 applies a first stiffness that acts on the first side 206 of the voice coil 205, and the second suspension element 204 applies a second stiffness that acts on the second side 207 of the voice coil 205. In an ideal case, the first stiffness is equal to the second stiffness. However, alternative cases for the first stiffness and the second stiffness may be utilized. Alternatively stated, the balanced state includes a two-sided application of stiffness/support. The two-sided application of stiffness/support occurs because the first suspension element 203 acts on the first side 206 of the voice coil 205, and the second suspension element 204 complementarily acts on the second side 207 of the voice coil 205. The two-sided application of stiffness/support provides for greater voice coil stability.

The first stiffness and the second stiffness may be desirably obtained by material selection and dimensioning for the first suspension element and the second suspension element (and any additional suspension elements). The first suspension element may be made of the same material as the second suspension element (and any additional suspension elements). Alternatively, the suspension elements may be made out of different materials. Some examples of materials for the suspension elements include rubbers (such as nitrile butadiene rubber), nonwoven fabrics, woven fabrics, foams, and other materials known in the art, such as other polymers and elastomeric materials.

Placing the voice coil 205 in the balanced state is acoustically desirable. For example, in the loudspeaker 200, placing the voice coil 205 in the balanced state reduces rocking, midband rubs, extraneous noise, permanent damage, and outright failure—at least compared to the conventional loudspeaker 100.

The loudspeaker 200 aligns along a longitudinal axis 208. The loudspeaker 200 includes a magnet assembly 209. The magnet assembly 209 attaches to a back plate 210. The back plate 210 attaches to a frame 211. The frame 211 encircles the magnet assembly 209 about the longitudinal axis 208. Moreover, the frame 211 and the magnet assembly 209 form a voice coil gap 212. The voice coil 205 is attached to a voice coil former 213, such as by winding therearound. Additionally, the voice coil 205 resides in the voice coil gap 212. The voice coil former 213 attaches to a diaphragm 214, such as through an adhesive or other ways known in the art. The first suspension element 203 attaches to the diaphragm 214 and the frame 211, such as through an adhesive or other ways known in the art. The second suspension element 204 attaches to the voice coil former 213 and the frame 211, such as through an adhesive or other ways known in the art. And a dust cap 215 attaches to the diaphragm 214, such as through an adhesive or other ways known in the art.

Along the longitudinal axis 208, the loudspeaker 200 includes an overall length L'. The overall length L' is defined by a first point 216 and a second point 217. The first point 216 is located in the first suspension region 201, and the second point 217 is located in the second suspension region 202. Along the longitudinal axis 208, the first point 216 corresponds to the dust cap 215, the diaphragm 214, the frame 211, or the first suspension element 203—whichever is most distally located from the second point 217 along the longitudinal axis 208. And along the longitudinal axis 208, the second point 217 corresponds to a location on the back plate 210 that is most distally located from the first point 216.

The first suspension region 201 extends in a first longitudinal direction 218, which is parallel to the longitudinal axis 208. The first longitudinal direction 218 extends from the first side 206 of the voice coil 205 toward the dust cap 215. The second suspension region 202 extends in a second longitudinal direction 219, which is parallel to the longitudinal axis 208. The second longitudinal direction 219 is opposite to the first longitudinal direction 218. Moreover, the second longitudinal direction 219 extends from the second side 207 of the voice coil 205 toward the back plate 210. Additionally, both the first suspension region 201 and the second suspension region 202 extend transversely from the longitudinal axis 208.

The magnet assembly 209 and the voice coil 205 align along the longitudinal axis 208. The magnet assembly 209 includes a first inner magnet 220. The first inner magnet 220 attaches to a transitional spacer 221. The transitional spacer 221 longitudinally separates the first inner magnet 220 from a second inner magnet 222. The second inner magnet 222 attaches to the transitional spacer 221. The magnet assembly 209 further includes a first intermediate spacer 223 that attaches to the first inner magnet 220. The first intermediate spacer 223 longitudinally separates the first inner magnet 220 from a first outer magnet 224. The first outer magnet 224 attaches to the first intermediate spacer 223 and a first end cap 225. A second intermediate spacer 226 attaches to the second inner magnet 222. The second intermediate spacer 226 longitudinally separates the second inner magnet 222 from a second outer magnet 227. The second outer magnet 227 attaches to the second intermediate spacer 226 and a second end cap 228. And the second end cap 228 attaches to the back plate 210. The attachments in the magnet assembly 209 and the magnet assembly 209 to the back plate 210 may occur via fasteners, adhesives, or other ways known in the art.

Along the longitudinal axis 208, the magnet assembly 209 includes a length M'. The length M' is less than the overall length L'. Additionally, the length M' is defined by a third point 229 and a fourth point 230. The fourth point 230 corresponds to the side of the second end cap 228 that rests on the back plate 210. And the third point 229 corresponds to the first end cap 225 at a location most distal to the fourth point 230. The magnet assembly 209 includes a halfway point 231 that is defined as the half the length of M'. The magnet assembly 209 from the halfway point 231 to the third point 229 is symmetrical to the magnet assembly 209 from the halfway point 231 to the fourth point 230. The halfway point 231 of the magnet assembly 209 corresponds to a halfway point 232 of the voice coil 205.

Along the longitudinal axis 208, the voice coil 205 includes a length O'. The length O' is defined by the first side 206 and the second side 207 of the voice coil 205. The halfway point 232 of the voice coil 205 is defined as half of the length of O'. On the longitudinal axis 208, at rest, the halfway point 232 of the voice coil 205 is at the same location as the halfway point 231 of the magnet assembly 209. Because of that, at rest, the voice coil 205 is symmetrically aligned with the magnet assembly 209.

The symmetrical alignment between the voice coil 205 and the magnet assembly 209 is acoustically desirable. For example, compared to an asymmetrical alignment (such as in the conventional loudspeaker 100), the symmetrical alignment yields substantially symmetric motor force (BL), suspension stiffness (K), and inductance (Le), which helps reduce nonlinear distortion, instability, etc.

Mathematically, the substantially symmetric motor force is determined from a motor force versus excursion plot for the loudspeaker 200. Based on the motor force versus excursion plot, an asymmetry motor force curve is determined for the loudspeaker 200. An asymmetry motor force value is determined by averaging the absolute value of the asymmetry motor force curve. The asymmetry value is less than 5%, which means that for motor force the loudspeaker 200 is at least 95% symmetric. Therefore, substantially symmetric motor force means that for motor force the loudspeaker 200 is at least 95% symmetric.

Mathematically, the substantially symmetric suspension stiffness is determined from a suspension stiffness versus excursion plot for the loudspeaker 200. Based on the suspension stiffness versus excursion plot, an asymmetry suspension stiffness curve is determined for the loudspeaker 200. An asymmetry suspension stiffness value is determined by averaging the absolute value of the asymmetry suspension stiffness curve. The asymmetry value is less than 5%, which means that for suspension stiffness the loudspeaker 200 is at least 95% symmetric. Therefore, substantially symmetric suspension stiffness means that for suspension stiffness the loudspeaker 200 is at least 95% symmetric.

Mathematically, the substantially symmetric inductance is determined from an inductance versus excursion plot for the loudspeaker 200. Based on the inductance versus excursion plot, an asymmetry inductance curve is determined for the loudspeaker 200. An asymmetry inductance value is determined by averaging the absolute value of the asymmetry inductance curve. The asymmetry value is less than 5%, which means that for inductance the loudspeaker 200 is at least 95% symmetric. Therefore, substantially symmetric inductance means that for inductance the loudspeaker 200 is at least 95% symmetric.

Along the longitudinal axis 208, in an ideal case, in the magnet assembly 209, the length of the first inner magnet 220 is equal to the length of the second inner magnet 222. Additionally, along the longitudinal axis 208, the length of the first outer magnet 224 is equal to the length of the second outer magnet 227. Furthermore, along the longitudinal axis 208, the length of the first intermediate spacer 223 is equal to the length of the second intermediate spacer 226. And along the longitudinal axis 208, the length of the first end cap 225 is equal to the length of the second end cap 228. The length of the first inner magnet 220 is greater than the length of the first outer magnet 224. And, therefore, the length of the second inner magnet 222 is greater than the length of the second outer magnet 227.

In the magnet assembly 209, the first inner magnet 220 includes a first permanence coefficient, and the second inner magnet 222 includes a second permanence coefficient. In an ideal case, the first permanence coefficient is equal to the second permanence coefficient. Additionally, the first outer magnet 224 includes a third permanence coefficient, and the second outer magnet 227 includes a fourth permanence coefficient. In an ideal case, the third permanence coefficient is equal to the fourth permanence coefficient. The first permanence coefficient and the second permanence coefficient are equal to or greater than the third permanence coefficient and the fourth permanence coefficient. This arrangement of the permanence coefficients creates a desirable magnetic flux flow through the voice coil 205. In this arrangement, the magnetic flux flow is at a maximum at half the length of the voice coil, which is desirable.

Additionally, in the magnet assembly 209, the permanence coefficients are within a target value range of one to two. At a value of one, a permanence coefficient provides a maximum magnetic energy (efficiency). And at a value of two, a permanence coefficient provides robustness against demagnetization.

In the magnet assembly 209, the first inner magnet 220, the second inner magnet 222, the first outer magnet 224, and the second outer magnet 227 may be made out of the same magnetic material. More specifically, each magnet (e.g., first inner magnet 220, first outer magnet 224, etc.) may be a neodymium magnet. Additionally, in the magnet assembly 209, the first intermediate spacer 223, the second intermediate spacer 226, the transitional spacer 221, the first end cap 225, and the second end cap 228 may be made out the same material. More specifically, each spacer (e.g., first intermediate spacer 223, etc.) and each end cap (e.g., first end cap 225, etc.) may be made out of low carbon steel. The voice coil 205 may be made out of copper or a number of different materials known in the art.

The magnet assembly 209 includes a first magnetic flux flow loop 233. The first magnetic flux flow loop 233 travels opposite to a second magnetic flux flow loop 234. For example, as shown in FIG. 3, the first magnetic flux flow loop 233 travels in a counter-clockwise direction, whereas the second magnetic flux flow loop 234 travels in a clockwise direction. Because of that, the first magnetic flux flow loop 233 constructively combines with the second magnetic flux flow loop 234 when entering the voice coil 205. At rest, the constructive combination is at a maximum at half the length O' of the voice coil 205. When transitioning out of the voice coil 205, the constructive combination deconstructs into the first magnetic flux flow loop 233 and the second magnetic flux flow loop 234.

In general, the first magnetic flux flow loop 233 travels from the first inner magnet 220, through the transitional spacer 221, into the voice coil 205, into the frame 211, into the first end cap 225, through the first outer magnet 224, into the first intermediate spacer 223, and back into the first inner magnet 220. And in general, the second magnetic flux flow loop 234 travels from the second inner magnet 222, through the transitional spacer 221, into the voice coil 205, into the frame 211, into the back plate 210, into the second end cap 228, into the second outer magnet 227, into the second intermediate spacer 226, and back into the second inner magnet 222.

To create the first magnetic flux flow loop 233 and the second magnetic flux flow loop 234, the magnets (e.g., the first inner magnet, the first outer magnet, etc.) are axially polarized. When aligned along the longitudinal axis 208, the first inner magnet 220 and the first outer magnet 224 have their axial polarities appropriately oriented to create the first magnetic flux flow loop 233. And the second inner magnet 222 and the second outer magnet 227 have their axial polarities appropriately oriented to create the second magnetic flux flow loop 234.

In the magnet assembly 209, the first inner magnet 220, the second inner magnet 222, the first outer magnet 224, and the second outer magnet 227 may be disks, rectangular plates, or other similar shapes. Additionally, the first intermediate spacer 223, the second intermediate spacer 226, the transitional spacer 221, the first end cap 225, and the second end cap 228 may be disks, rectangular plates, or other similar shapes.

In the loudspeaker 200, the back plate 210 may be made out of plastic, aluminum, or a number of different non-ferrous materials known in the art. Using a non-ferrous material for the back plate 210 helps maintain magnetic symmetry in the loudspeaker 200. More specifically, because the non-ferrous material does not influence the second magnetic flux flow loop 234, at rest, the second magnetic flux flow loop 234 may be a mirror image of the first magnetic flux flow loop 233. Additionally, the diaphragm 214 may be made out of carbon fiber, fiberglass, paper, or a number of different materials known in the art. Furthermore, the frame 211 may be made out of low carbon steel or a number of different ferrous materials known in the art.

In the loudspeaker 200, the frame 211 includes an outer wall 235 that forms the voice coil gap 212 with the magnet assembly 209. Extending from the outer wall 235 to the first suspension element 203, the frame 211 includes a first basket 236. In relation to the longitudinal axis 208, the first basket 236 generally extends angularly outward from the outer wall 235. In the first basket 236, the angular extension from the outer wall 235 terminates at a distal first portion 237. The first suspension element 203 attaches to the first portion 237. The first portion 237 is located in the first suspension region 201 and is transversely spaced from the longitudinal axis 208.

In the loudspeaker 200, extending from the outer wall 235 to the second suspension element 204, the frame 211 includes a second basket 238. In relation to the longitudinal axis 208, the second basket 238 generally extends angularly outward from the outer wall 235. In the second basket 238, the angular extension from the outer wall 235 terminates at a distal second portion 239. The second suspension element 204 attaches to the second portion 239. The second portion 239 is located in the second suspension region 202 and is transversely spaced from the longitudinal axis 208. Therefore, the first portion 237 is spaced apart from the second portion 239. The outer wall 235, the first basket 236, and the second basket 238 may be integrally formed or may be modularly attached, such as through fasteners.

Along the longitudinal axis 208, the outer wall includes a length P'. The length P' of the outer wall 235 may be less than, equal to, or greater than the length O' of the voice coil 205. Along the longitudinal axis 208, the outer wall 235 includes a halfway point 240 that is defined as half of the length of P'. When the voice coil 205 is at rest, the halfway point 240 of the outer wall 235 is at the same location as the halfway point 232 of the voice coil 205.

In a shallow-depth environment, the length P' of the outer wall 235 may be maximized based on a shallow depth of the shallow-depth environment. One reason for doing so is that the length P' of the outer wall 235 directly impacts the motor force of the loudspeaker 200. In a scenario where the overall length L' is equal to the shallow depth, and is therefore maximally constrained, the largest value for P' may be selected such that the overall Length L' does not increase. Alternatively, a value smaller than the largest value for P' may be selected, but the overall length L' could remain the same. Therefore, to influence motor force, the shallow-depth environment may only require altering the length P', as opposed to having to also alter the magnet assembly 209, the voice coil 205, the overall length L', etc. For any alteration, though, the loudspeaker 200 maintains the balanced state, the substantially symmetrical motor force, the substantially symmetrical suspension stiffness, and the substantially symmetrical inductance.

Often, increasing the length P' of the outer wall 235 results in a greater motor force. For example, if the length P' of the outer wall 235 is less than the length M' of the magnet assembly 209, then increasing the length P' to equal the length M' yields an increase in motor force. One reason for that is due to the relationship between the outer wall 235 and the magnet assembly 209. More specifically, increasing the length P', as described in the example, influences the first magnetic flux flow loop 233 and the second magnetic flux flow loop 234. In particular, that influence affects the return paths (e.g., from the voice coil, through the frame, and back into the magnet assembly) of the first magnetic flux flow loop 233 and the second magnetic flux flow loop 234. Because of that, if the length M' of the magnet assembly 209 is held constant, then the length P' of the outer wall 235 may be adjusted to obtain the maximum motor force.

In some instances, increasing the length P' does not result in increasing the overall length L'. While in other instances increasing the length P' of the outer wall 235 may result in increasing the overall length L' of the loudspeaker 200. The fact that no additional magnets, voice coils, etc., need to be added, though, may make the loudspeaker 200 desirable. Two reasons for that are complexity of such a change is low and financial cost remains largely unchanged.

During operation of the loudspeaker 200, the voice coil 205 may translate longitudinally along the longitudinal axis 208. More specifically, during operation of the loudspeaker 200, the voice coil 205 may cause the voice coil former 213 to translate longitudinally along the longitudinal axis 208.

Additionally, because of the balanced state, the voice coil 205 may be able to maintain an ideal alignment in the voice coil gap 212. For example, transversely to the longitudinal axis 208, the spacing between the outer wall 235 and the voice coil 205 would be consistent along the voice coil length O'. Similarly, transversely to the longitudinal axis 208, the spacing between the magnet assembly 209 and the voice coil 205 would be consistent along the voice coil length O'. Additionally, the transverse spacing between the magnet assembly 209 and the voice coil 205 (along length O'), and the transverse spacing between the outer wall 235 and the voice coil 205 (along length O'), would stay constant during translation of the voice coil 205 along the longitudinal axis 208.

At the very least, because of the balanced state, the voice coil 205 is able to maintain a desirable alignment in the voice coil gap 212. In the desirable alignment, the risk of rocking, midband rubs, extraneous noise, etc., is low-especially when compared against the risks in the conventional loudspeaker. Moreover, unlike the conventional loudspeaker 100, in the event that the voice coil 205 were to move in a direction transverse to the longitudinal axis 208, that movement would be insignificant and essentially uniform (if not entirely uniform) along the length O'.

Figure 4:
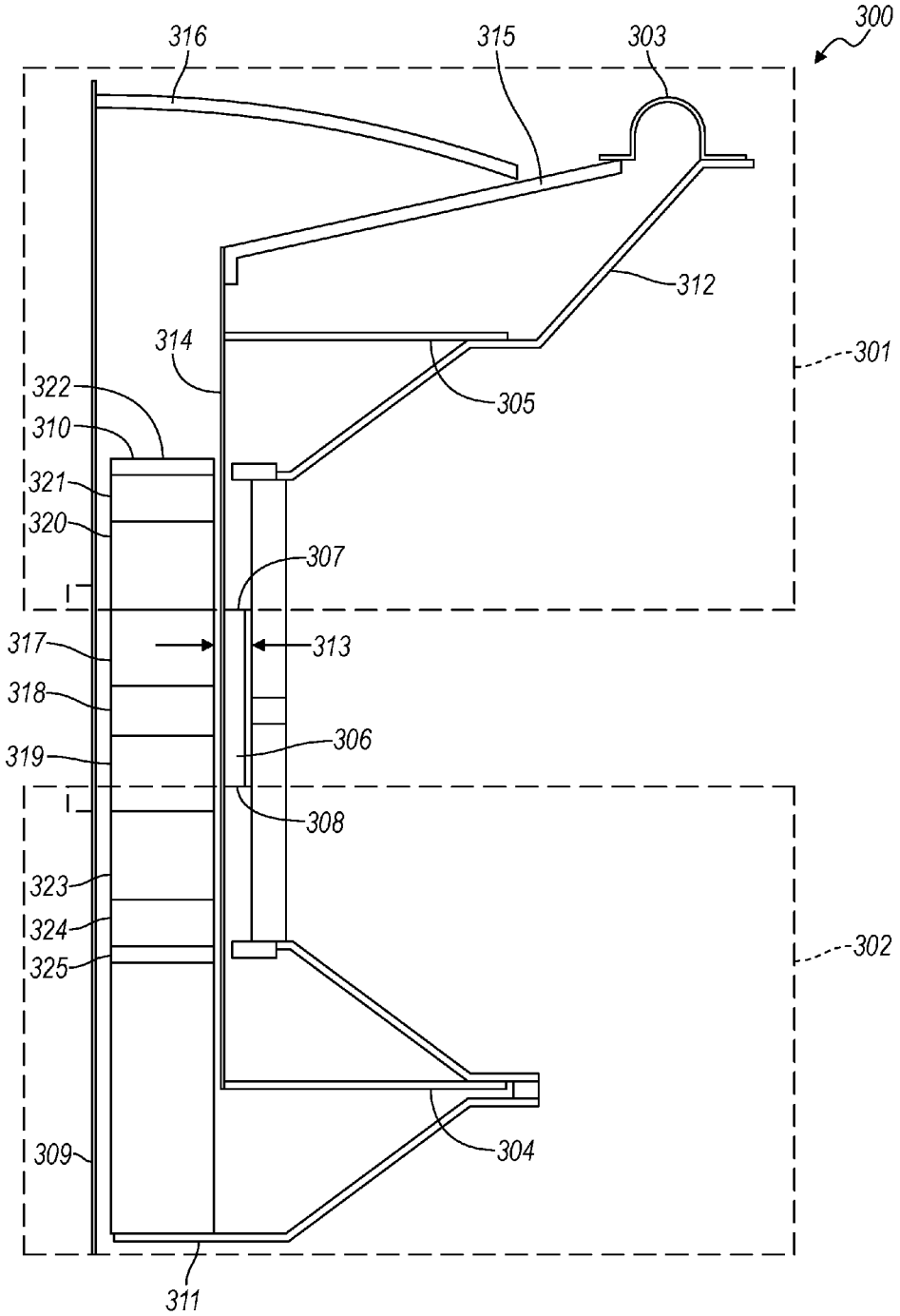
FIG. 4 is a partial section view of a loudspeaker according to one or more embodiments.
Figure 5:
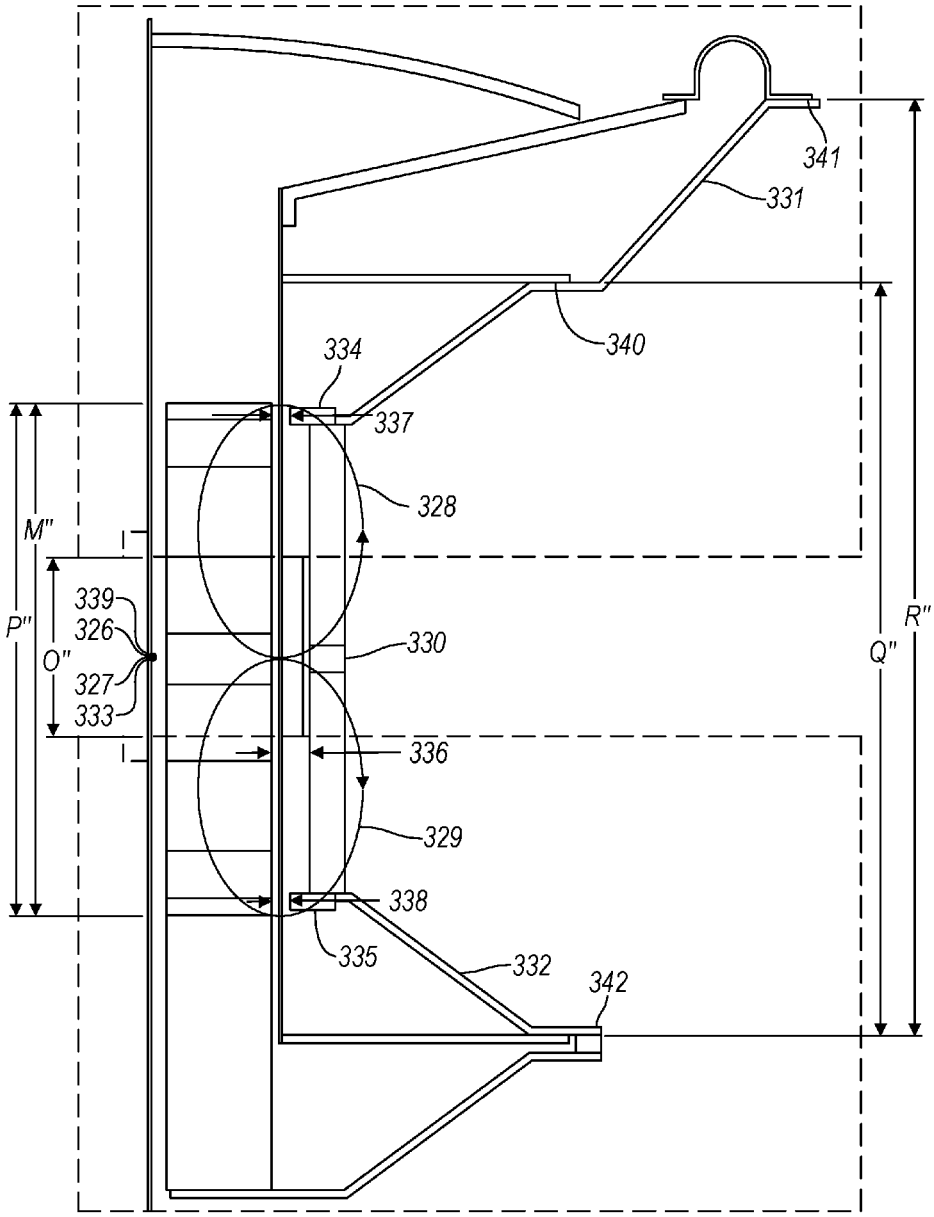
FIG. 5 illustrates magnetic flux flow loops on the loudspeaker of the partial section view from FIG. 4.

FIGS. 4 and 5 illustrate partial views of a loudspeaker 300, which is in accordance with one or more embodiments of the present invention. The loudspeaker 300 includes a first suspension region 301. The first suspension region 301 is longitudinally separated from a second suspension region 302. The first suspension region 301 includes a first suspension element 303. The second suspension region 302 includes a second suspension element 304. Furthermore, the first suspension region 301 includes a third suspension element 305. The first suspension element 303 may be a surround, the third suspension element 305 may be a first spider, and the second suspension element 304 may be a second spider.

The first suspension region 301 and the second suspension region 302 place a voice coil 306 in a balanced state. More specifically, the first suspension region 301 includes at least one suspension element (e.g., the first suspension element 303) that acts on a first side 307 of the voice coil 306, and the second suspension region 302 includes at least one other suspension element (i.e., the second suspension element 304) that acts on a second side 308 of the voice coil 306.

In the loudspeaker 300, the first suspension element 303 acts on the first side 307 of the voice coil 306. Additionally, the second suspension element 304 acts on the second side 308 of the voice coil 306. And the third suspension element 305 acts on the first side 307 of the voice coil 306. Alternatively stated, the first suspension element 303 and the third suspension element 305 support the first side 307 of the voice coil 306, and the second suspension element 304 supports the second side 308 of the voice coil 306. In doing so, the first suspension element 303 applies a first stiffness to the first side 307 of the voice coil 306, the second suspension element 304 applies a second stiffness to the second side 308 of the voice coil 306, and the third suspension element 305 applies a third stiffness to the first side 307 of the voice coil 306. In an ideal case, the first stiffness and the third stiffness total to equal the second stiffness. However, alternative cases for the first stiffness, the second stiffness, and the third stiffness may be utilized.

This combination of the three suspension elements 303, 304, 305, as oriented in the two suspension regions 301, 302, is particularly desirable for heavier weighted voice coils. Additionally, the combination of the three suspension elements 303, 304, 305, as oriented in the two suspensions regions 301, 302, is particularly desirable for voice coils that operate at high excursions. In such scenarios, the three suspension elements 303, 304, 305, as oriented in the two suspension regions 301, 302, should provide greater voice coil stability and life.

The loudspeaker 300 aligns along a longitudinal axis 309. Therefore, the voice coil 306 and a magnet assembly 310 align along the longitudinal axis 309. The magnet assembly 310 attaches to a back plate 311. The back plate attaches to a frame 312. The frame 312 and the magnet assembly 310 form a voice coil gap 313. The voice coil 306 is wound around a voice coil former 314 and resides in the voice coil gap 313. The voice coil former 314 attaches to a diaphragm 315. In the first suspension region 301, the first suspension element 303 attaches to the diaphragm 315 and the frame 312. In the second suspension region 302, the second suspension element 304 attaches to the voice coil former 314 and the frame 312. In the first suspension region 301, the third suspension element 305 attaches to the voice coil former 314 and the frame 312, such as through an adhesive or other ways known in the art. And a dust cap 316 attaches to the diaphragm.

Along the longitudinal axis 309, the first suspension region 301 extends from the first side 307 of the voice coil 306 toward the dust cap 316. And along the longitudinal axis 309, the second suspension region 302 extends from the second side 308 of the voice coil 306 toward the back plate 311. The first suspension region 301 and the second suspension region 302 further extend transversely from the longitudinal axis 309.

The magnet assembly 310 includes a first inner magnet 317. The first inner magnet 317 attaches to a transitional spacer 318. The transitional spacer 318 attaches to a second inner magnet 319. The magnet assembly 310 further includes a first intermediate spacer 320 that attaches to the first inner magnet 317. A first outer magnet 321 attaches to the first intermediate spacer 320. And a first end cap 322 attaches to the first outer magnet 321. Additionally, the magnet assembly 310 includes a second intermediate spacer 323 that attaches to the second inner magnet 319. A second outer magnet 324 attaches to the second intermediate spacer 323. And a second end cap 325 attaches to the first outer magnet 321 and the back plate 311.

Along the longitudinal axis 309, the magnet assembly 310 includes a length M". The length M" is defined by the first end cap 322 and the second end cap 325. The magnet assembly 310 includes a halfway point 326 that is defined as half of the length M". The magnet assembly 310 from the halfway point 326 to the first end cap 322 is symmetrical to the halfway point 326 to the second end cap 325. The halfway point 326 of the magnet assembly 310 corresponds to a halfway point 327 of the voice coil 306.

Along the longitudinal axis 309, the voice coil 306 includes a length O". The length O" is defined by the first side 307 and the second side 308 of the voice coil 306. The halfway point 327 of the voice coil is defined as half of the length of O". On the longitudinal axis 309, at rest, the halfway point 327 of the voice coil 306 is at the same location as the halfway point 326 of the magnet assembly 310. Because of that, at rest, the voice coil 306 is symmetrically aligned with the magnet assembly 310. The symmetrical alignment yields substantially symmetric motor force and inductance for the loudspeaker 300.

The magnet assembly 310 includes a first magnetic flux flow loop 328. The first magnetic flux flow loop 328 travels opposite to a second magnetic flux flow loop 329. For example, if the first magnetic flux flow loop 328 travels in a counter-clockwise direction, then the second magnetic flux flow loop 329 travels in a clockwise direction. Because of that, the first magnetic flux flow loop 328 constructively combines with the second magnetic flux flow loop 329 when entering the voice coil 306. At rest, the constructive combination is at a maximum at half the length O" of the voice coil 306. When transitioning out of the voice coil 306, the constructive combination deconstructs into the first magnetic flux flow loop 328 and the second magnetic flux flow loop 329.

In the loudspeaker 300, the frame 312 includes an outer wall 330 that forms the voice coil gap 313 with the magnet assembly 310. Extending from the outer wall 330 to the first suspension element 303, the frame 312 includes a first basket 331. Extending from the outer wall 330 to the second suspension element 304, the frame 312 includes a second basket 332.

Along the longitudinal axis 309, the outer wall includes a length P". The length P" of the outer wall 330 is equal to the length M" of the magnet assembly 310. Along the longitudinal axis 309, the outer wall 330 includes a halfway point 333 that is defined as half of the length of P". When the voice coil 306 is at rest, the halfway point 333 of the outer wall 330 is at the same location as the halfway point 327 of the voice coil 306.

The outer wall 330 includes a first projection 334. The first projection 334 forms a first end of the outer wall 330. Additionally, the outer wall 330 includes a second projection 335. The second projection 335 forms a second end of the outer wall 330. The first projection 334 is, therefore, longitudinally spaced from the second projection 335. And therefore, the length P" of the outer wall 330 is defined by the first projection 334 and the second projection 335.

Between the first projection 334 and the second projection 335, but not including the first projection 334 or the second projection 335, the voice coil gap 313 includes a major width 336. At rest, the major width 336 is measured transversely to the longitudinal axis 309.

The voice coil gap 313 further includes a first minor width 337. At rest, the first minor width 337 is measured transversely to the longitudinal axis 309. In doing so, the first minor width 337 is measured from the magnet assembly 310 (e.g., from the first end cap 322) to the first projection 334. The first minor width 337 is less than the major width 336.

The voice coil gap 313 further includes a second minor width 338. At rest, the second minor width 338 is measured transversely to the longitudinal axis 309. In doing so, the second minor width 338 is measured from the magnet assembly 310 (e.g., from the second end cap 325) to the second projection 335. The second minor width 338 is less than the major width 336. The second minor width 338 may be equal to the first minor width 337.

Through the first minor width 337 and the second minor width 338, the first projection 334 and the second projection 335 increase the motor force of the loudspeaker 300. Without the first projection 334 and the second projection 335, the motor force of the loudspeaker 300 would be noticeably less.

Along the longitudinal axis 309, the second suspension element 304 is spaced from the third suspension element 305 by a distance Q". The distance Q" includes a halfway point 339. The halfway point 339 of the distance Q" may correspond to the halfway point 326 of the magnet assembly 310. Additionally, along the longitudinal axis 309, the second suspension element 304 is longitudinally spaced from the first suspension element 303 by a distance R". The distance R" is greater than the distance Q".

The third suspension element 305 attaches to the frame 312 at an intermediate location 340 on the first basket 331. On the first basket 331, the intermediate location 340 is located between the initial extension from the outer wall 330 and a distal first portion 341. The first suspension element 303 attaches to the frame 312 at the first portion 341. Similarly, the second basket 332 extends from the outer wall 330 to a distal second portion 342. The second suspension element 304 attaches to the frame 312 at the second portion 342.

Figure 6:
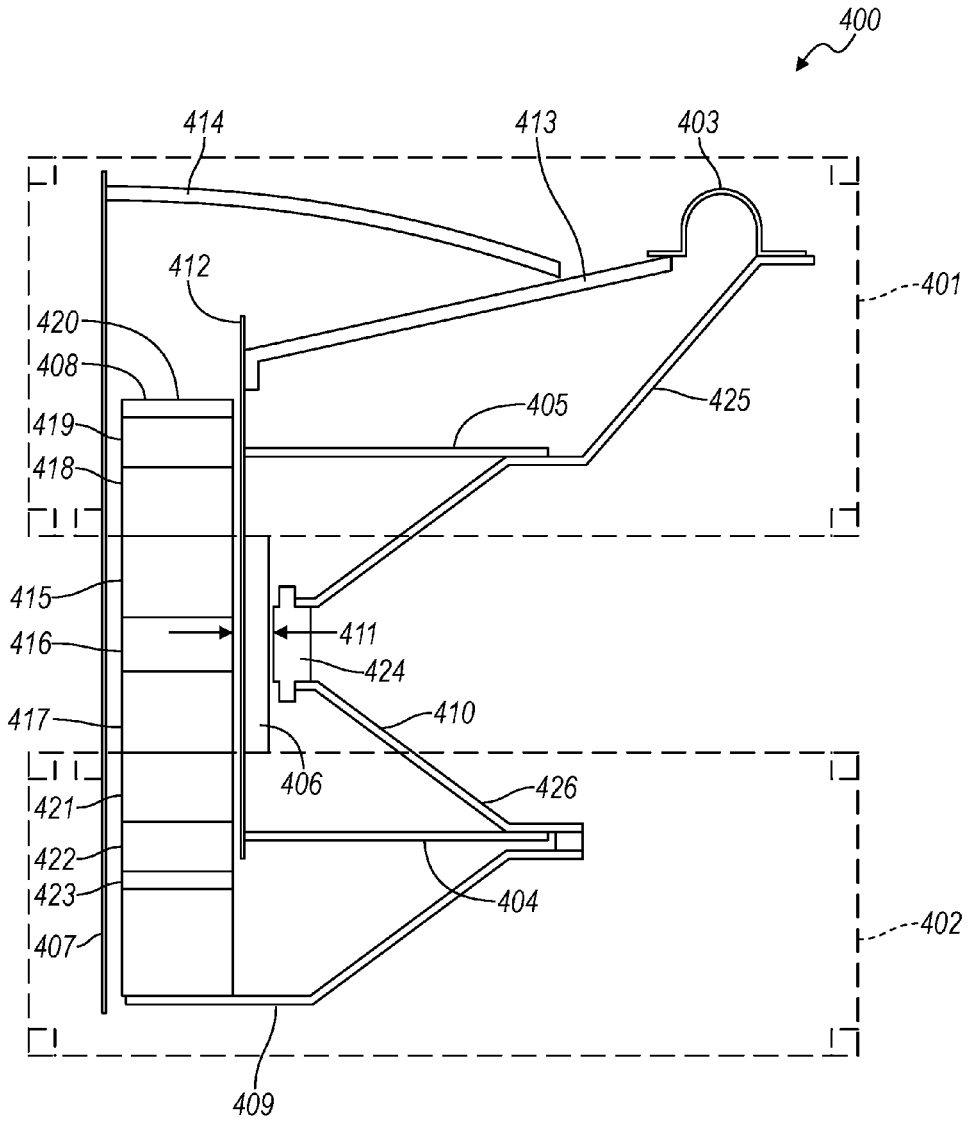
FIG. 6 is a partial section view of a loudspeaker according to one or more embodiments.

FIG. 6 illustrates a partial view of a loudspeaker 400, which is in accordance with one or more embodiments of the present invention. The loudspeaker 400 includes a first suspension region 401. The first suspension region 401 is longitudinally separated from a second suspension region 402. The first suspension region 401 includes a first suspension element 403. The second suspension region 402 includes a second suspension element 404. Furthermore, the first suspension region 401 includes a third suspension element 405. The first suspension region 401 and the second suspension region 402 place a voice coil 406 of the loudspeaker 400 in a balanced state.

The loudspeaker 400 aligns along a longitudinal axis 407. Therefore, the voice coil 406 and a magnet assembly 408 align along the longitudinal axis 407. The magnet assembly 408 attaches to a back plate 409. The back plate attaches to a frame 410. The frame 410 and the magnet assembly 408 form a voice coil gap 411. The voice coil 406 is wound around a voice coil former 412 and resides in the voice coil gap 411. The voice coil former 412 attaches to a diaphragm 413. In the first suspension region 401, the first suspension element 403 attaches to the diaphragm 413 and the frame 410. In the second suspension region 402, the second suspension element 404 attaches to the voice coil former 412 and the frame 410. In the first suspension region 401, the third suspension element 405 attaches to the voice coil former 412 and the frame 410. And a dust cap 414 attaches to the diaphragm.

The magnet assembly 408 includes a first inner magnet 415. The first inner magnet 415 attaches to a transitional spacer 416. The transitional spacer 416 attaches to a second inner magnet 417. The magnet assembly 408 further includes a first intermediate spacer 418 that attaches to the first inner magnet 415. A first outer magnet 419 attaches to the first intermediate spacer 418. And a first end cap 420 attaches to the first outer magnet 419. Additionally, the magnet assembly 408 includes a second intermediate spacer 421 that attaches to the second inner magnet 417. A second outer magnet 422 attaches to the second intermediate spacer 421. And a second end cap 423 attaches to the second outer magnet 422 and the back plate 409.

At rest, the voice coil 406 is symmetrically aligned with the magnet assembly 408. The symmetrical alignment yields substantially symmetric motor force and inductance for the loudspeaker 400.

In the loudspeaker 400, the frame 410 includes an outer wall 424 that forms the voice coil gap 411 with the magnet assembly 408. Extending from the outer wall 424 to the first suspension element 403, the frame 410 includes a first basket 425. Extending from the outer wall 424 to the second suspension element 404, the frame 410 includes a second basket 426. The length of the outer wall 424 is less than the length of the voice coil 406.

FIGS. 7 through 13, and 14B illustrate results from laboratory testing a loudspeaker based on the loudspeaker 400 of FIG. 6 (hereinafter referred to as "Sym-Bal Loudspeaker"). Additionally, FIGS. 7 through 13, and 14A illustrate results from laboratory testing a loudspeaker based on the conventional loudspeaker 100 of FIG. 1 (hereinafter referred to as "Reference Loudspeaker"). For the laboratory testing, the Sym-Bal Loudspeaker and the Reference Loudspeaker were designed to carry out a fair comparison. Because of that, extensive thought was given to dimensioning and material selection.

Figure 7:
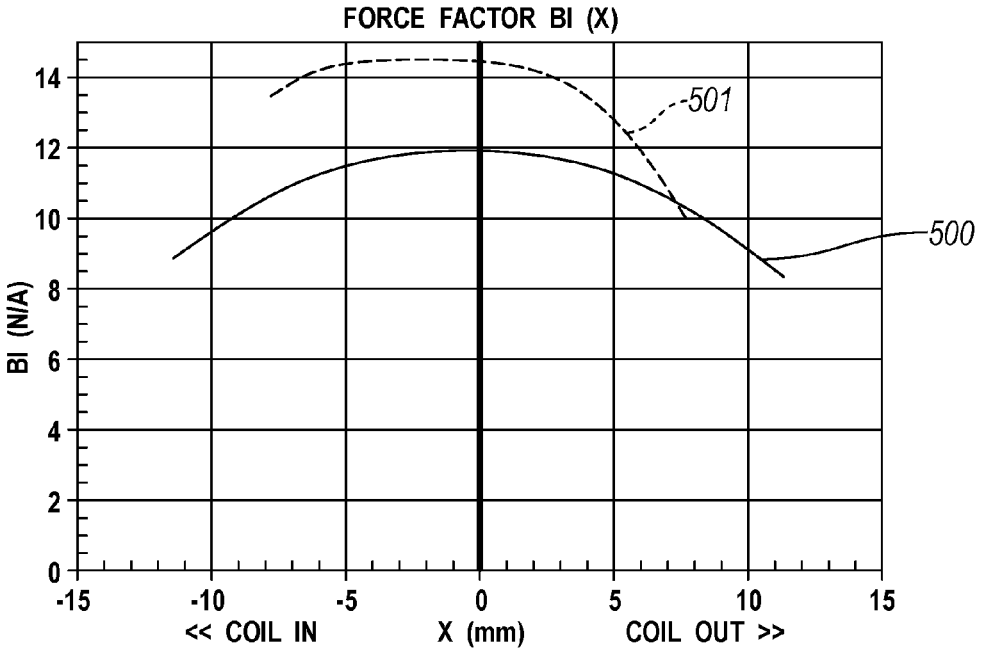
FIG. 7 illustrates laboratory test results for motor force versus excursion of a conventional loudspeaker according to FIG. 1 and a loudspeaker according to FIG. 6.

FIG. 7 illustrates a motor force versus excursion curve for the Sym-Bal Loudspeaker 500. Additionally, FIG. 7 illustrates a motor force versus excursion curve for the Reference Loudspeaker 501. The motor force versus excursion curve for the Sym-Bal Loudspeaker 500 indicates a great deal of symmetry, whereas the motor force versus excursion curve for the Reference Loudspeaker 501 does not. The motor force symmetry for the Sym-Bal Loudspeaker, and the lack of motor force symmetry for the Reference Loudspeaker, is further illustrated in FIG. 8.

Figure 8:
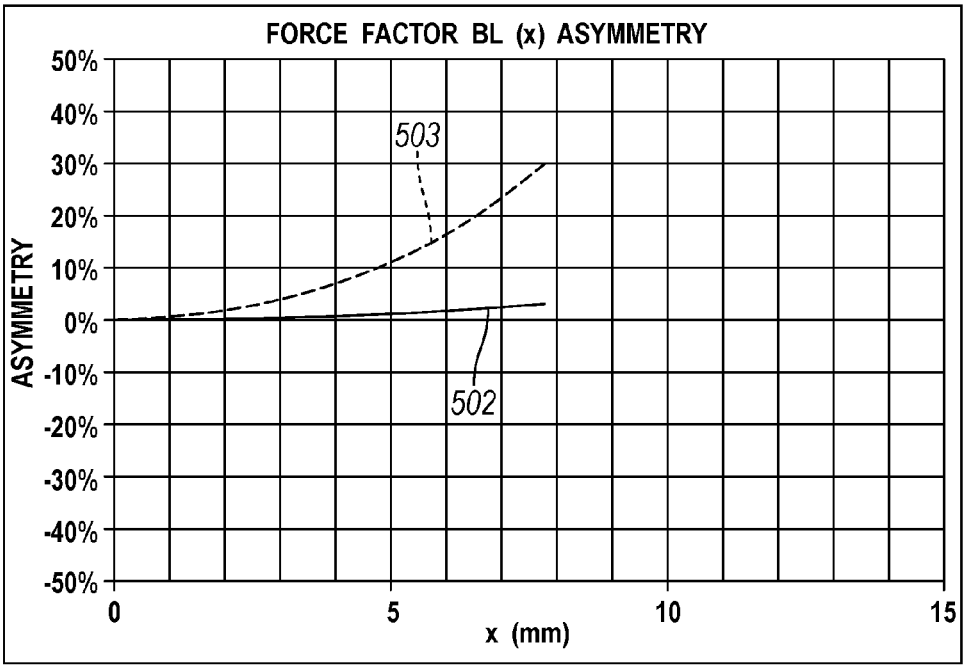
FIG. 8 illustrates curves for asymmetry based on the motor force versus excursion results from FIG. 7.

FIG. 8 illustrates an asymmetry motor force curve for the Sym-Bal Loudspeaker 502, which is based on the motor force versus excursion curve for the Sym-Bal Loudspeaker 500. Additionally, FIG. 8 illustrates an asymmetry motor force curve for the Reference Loudspeaker 503, which is based on the motor force versus excursion curve for the Reference Loudspeaker 501. The asymmetry motor force curve for the Sym-Bal Loudspeaker is nearly flat, which also indicates the great deal of symmetry. And as expected, the asymmetry motor force curve for the Reference Loudspeaker indicates lack of symmetry.

Averaging the absolute values of the asymmetry motor force curve for the Sym-Bal Loudspeaker 502 returns an asymmetry motor force value of 1.2%. Therefore, the Sym-Bal Loudspeaker includes a substantially symmetric motor force. And averaging the absolute values of the asymmetry motor force curve for the Reference Loudspeaker 503 returns an asymmetry motor force value of 9.6%. Therefore, the Reference Loudspeaker does not include a substantially symmetric motor force; instead, the motor force for the Reference Loudspeaker is significantly asymmetric.

Figure 9:
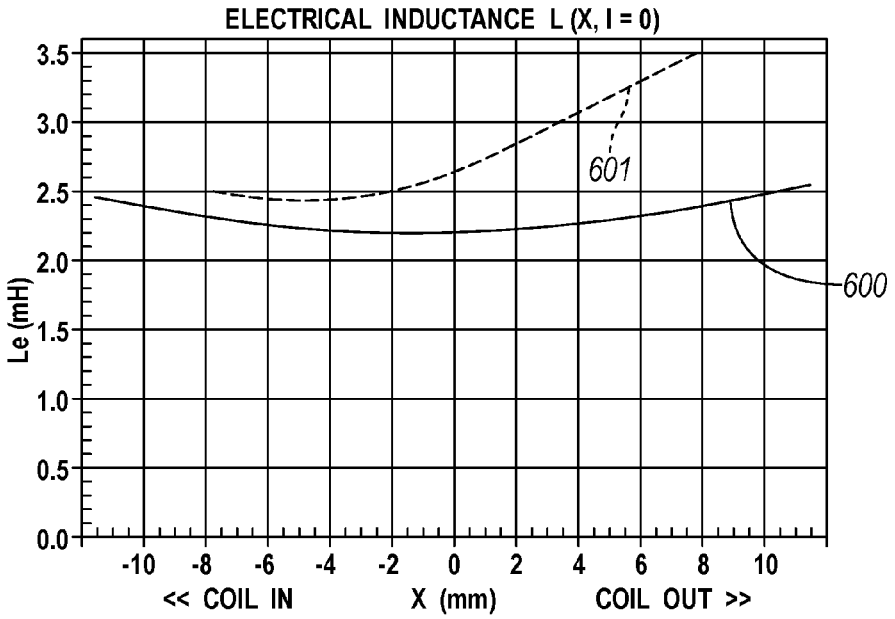
FIG. 9 illustrates laboratory test results for inductance versus excursion of a conventional loudspeaker according to FIG. 1 and a loudspeaker according to FIG. 6.

FIG. 9 illustrates an inductance versus excursion curve for the Sym-Bal Loudspeaker 600. Additionally, FIG. 9 illustrates an inductance versus excursion curve for the Reference Loudspeaker 601. The inductance versus excursion curve for the Sym-Bal Loudspeaker 600 indicates a great deal of symmetry, whereas the inductance versus excursion curve for the Reference Loudspeaker 601 does not. The inductance symmetry for the Sym-Bal Loudspeaker, and the lack of inductance symmetry for the Reference Loudspeaker, is further illustrated in FIG. 10.

Figure 10:
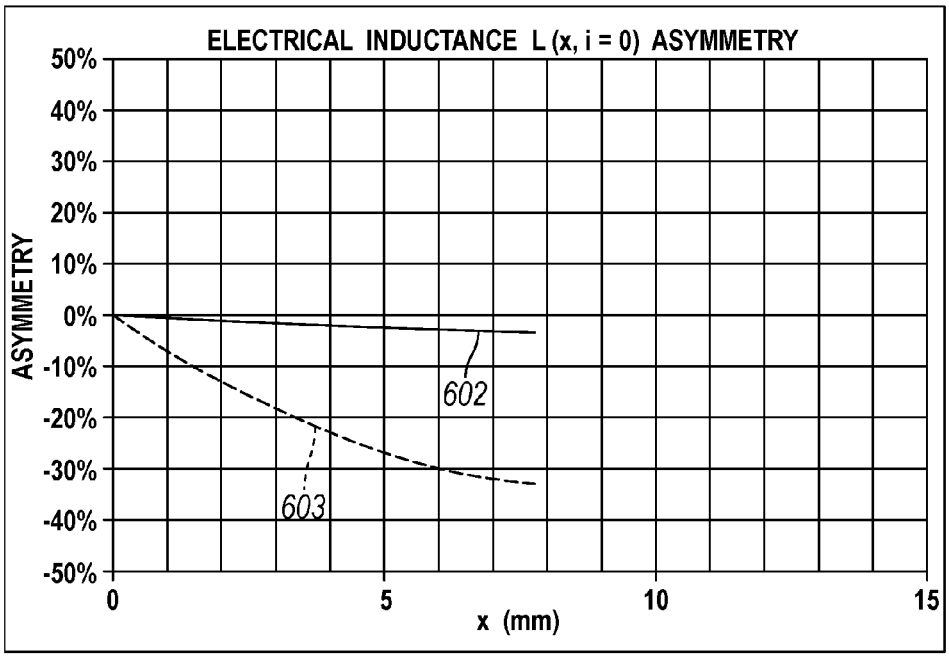
FIG. 10 illustrates curves for asymmetry based on the inductance versus excursion results from FIG. 9.

FIG. 10 illustrates an asymmetry inductance curve for the Sym-Bal Loudspeaker 602, which is based on the inductance versus excursion curve for the Sym-Bal Loudspeaker 600. Additionally, FIG. 10 illustrates an asymmetry inductance curve for the Reference Loudspeaker 603, which is based on the inductance versus excursion curve for the Reference Loudspeaker 601. The asymmetry inductance curve for the Sym-Bal Loudspeaker is nearly flat, which also indicates the great deal of symmetry. And as expected, the asymmetry inductance curve for the Reference Loudspeaker indicates lack of symmetry.

Averaging the absolute values of the asymmetry inductance curve for the Sym-Bal Loudspeaker 602 returns an asymmetry inductance value of 1.7%. Therefore, the Sym-Bal Loudspeaker includes a substantially symmetric inductance. And averaging the absolute values of the asymmetry inductance curve for the Reference Loudspeaker 603 returns an asymmetry inductance value of 20.2%. Therefore, the Reference Loudspeaker does not include a substantially symmetric inductance; instead, the inductance for the Reference Loudspeaker is significantly asymmetric.

Figure 11:
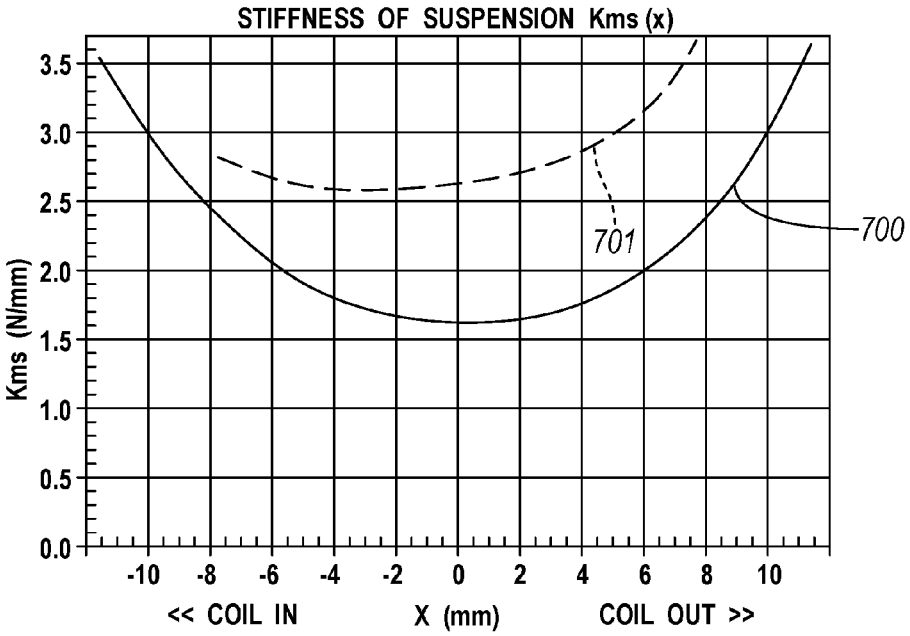
FIG. 11 illustrates laboratory test results for suspension stiffness versus excursion of a conventional loudspeaker according to FIG. 1 and a loudspeaker according to FIG. 6.

FIG. 11 illustrates a suspension stiffness versus excursion curve for the Sym-Bal Loudspeaker 700. Additionally, FIG. 11 illustrates a suspension stiffness versus excursion curve for the Reference Loudspeaker 701. The suspension stiffness versus excursion curve for the Sym-Bal Loudspeaker 700 indicates a great deal of symmetry, whereas the suspension stiffness versus excursion curve for the Reference Loudspeaker 701 does not. The suspension stiffness symmetry for the Sym-Bal Loudspeaker, and the lack of suspension stiffness symmetry for the Reference Loudspeaker, is further illustrated in FIG. 12.

Figure 12:
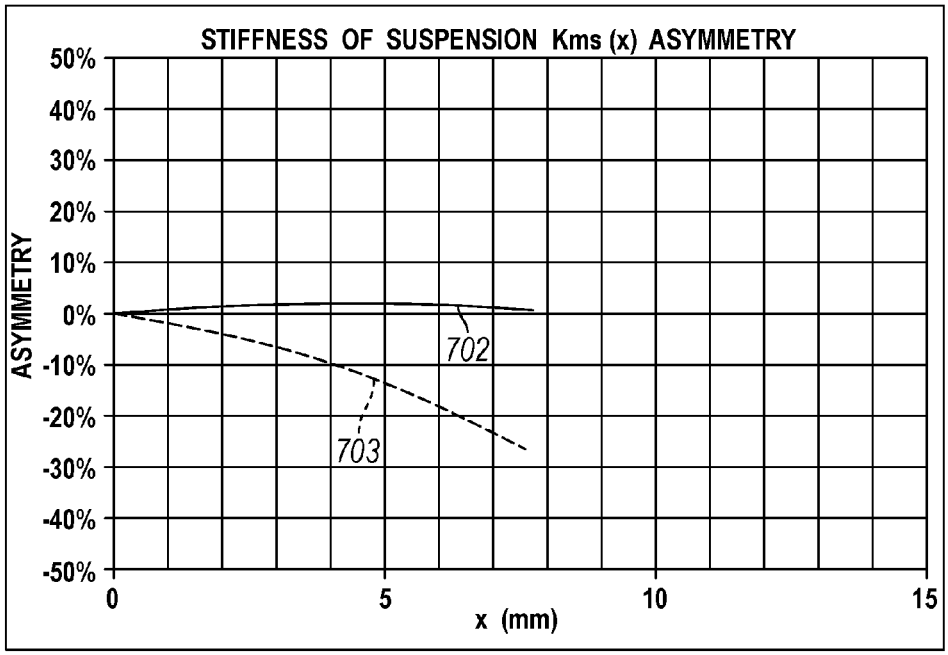
FIG. 12 illustrates curves for asymmetry based on the suspension stiffness versus excursion results from FIG. 11.

FIG. 12 illustrates an asymmetry suspension stiffness curve for the Sym-Bal Loudspeaker 702, which is based on the suspension stiffness versus excursion curve for the Sym-Bal Loudspeaker 700. Additionally, FIG. 12 illustrates an asymmetry suspension stiffness curve for the Reference Loudspeaker 703, which is based on the suspension stiffness versus excursion curve for the Reference Loudspeaker 701. The asymmetry suspension stiffness curve for the Sym-Bal Loudspeaker is nearly flat, which also indicates the great deal of symmetry. And as expected, the asymmetry suspension stiffness curve for the Reference Loudspeaker indicates lack of symmetry.

Averaging the absolute values of the asymmetry suspension stiffness curve for the Sym-Bal Loudspeaker 702 returns an asymmetry suspension stiffness value of 1.6%. Therefore, the Sym-Bal Loudspeaker includes a substantially symmetric suspension stiffness. And averaging the absolute values of the asymmetry suspension stiffness curve for the Reference Loudspeaker 703 returns an asymmetry suspension stiffness value of 10.6%. Therefore, the Reference Loudspeaker does not include a substantially symmetric suspension stiffness.

Figure 13A:
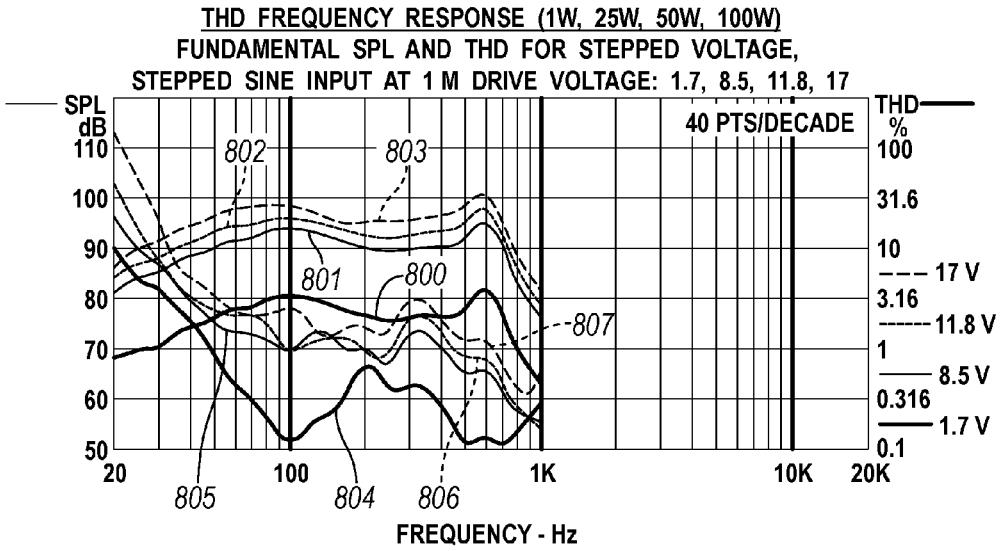
FIG. 13A illustrates additional laboratory test results for sound pressure level (SPL) and total harmonic distortion (THD) of a loudspeaker according to FIG. 6.

FIG. 13A illustrates sound pressure level (SPL) frequency responses between 20 Hz and 1,000 Hz for the Sym-Bal Loudspeaker at four different drive voltages: 1.7V, 8.5V, 11.8V, and 17V (respectively identified as 800, 801, 802, and 803). Additionally, FIG. 13A illustrates total harmonic distortion (THD) frequency responses between 20 Hz and 1,000 Hz for the Sym-Bal Loudspeaker at four different drive voltages: 1.7V, 8.5V, 11.8V, and 17V (respectively identified as 804, 805, 806, and 807). Therefore, the SPL response at 1.7V 800 corresponds to the THD response at 1.7V 804 for the Sym-Bal Loudspeaker, as do the 8.5V SPL 801 and the 8.5V THD 805, the 11.8V SPL 802 and the 11.8V THD 806, and the 17V SPL 803 and the 17V THD 807.

Figure 13B:
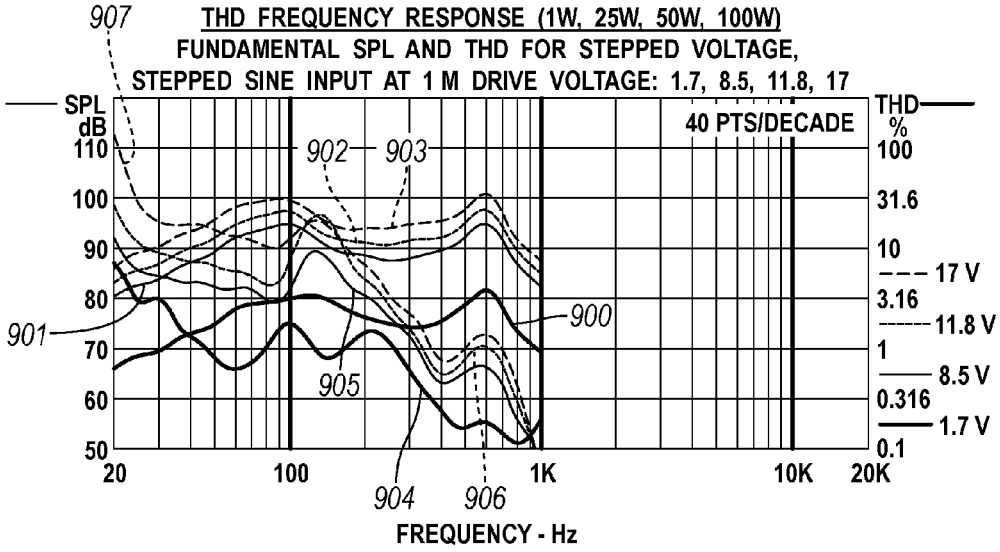
FIG. 13B illustrates additional laboratory test results for sound pressure level (SPL) and total harmonic distortion (THD) of a loudspeaker according to FIG. 1.

FIG. 13B illustrates sound pressure level (SPL) frequency responses between 20 Hz and 1,000 Hz for the Reference Loudspeaker at four different drive voltages: 1.7V, 8.5V, 11.8V, and 17V (respectively 900, 901, 902, and 903). Additionally, FIG. 13B illustrates total harmonic distortion (THD) frequency responses between 20 Hz and 1,000 Hz for the Reference Loudspeaker at four different drive voltages: 1.7V, 8.5V, 11.8V, and 17V (respectively identified as 904, 905, 906, and 907). Therefore, the SPL response at 1.7V 900 corresponds to the THD response at 1.7V 904 for the Reference Loudspeaker, as do the 8.5V SPL 901 and the 8.5V THD 905, the 11.8V SPL 902 and the 11.8V THD 906, and the 17V SPL 903 and the 17V THD 907. For SPL frequency responses, the Sym-Bal Loudspeaker occasionally yields higher SPL than the Reference Loudspeaker. E.g., SPL frequency response at 17V 803 for Sym-Bal Loudspeaker between 20 Hz and 55 Hz to SPL frequency response at 17V 903 for the Reference Loudspeaker between 20 Hz and 55 Hz. In addition to the occasional higher SPL yield, the Sym-Bal Loudspeaker significantly outperforms the Reference Loudspeaker in regard to THD frequency responses. E.g., the THD frequency response at 17V 807 for Sym-Bal Loudspeaker between 40 Hz and 110 Hz to the THD frequency response at 17V 907 for Reference Loudspeaker between 40 Hz and 110 Hz.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a magnet assembly aligned along a longitudinal axis;

a frame encircled around the magnet assembly, wherein the magnet assembly and the frame form a voice coil gap therebetween;

a voice coil disposed in the voice coil gap and mounted for translation along the longitudinal axis, wherein the voice coil includes a first side longitudinally spaced from a second side;

a voice coil former attached to the voice coil;

a diaphragm attached to the voice coil former and adjacent to the first side of the voice coil;

a first suspension element attached to the diaphragm and the frame for supporting the first side of the voice coil during translation; and a second suspension element attached to the voice coil former, adjacent to the second side of the voice coil, and attached to the frame for supporting the second side of the voice coil during translation;

wherein the voice coil is symmetrically aligned with the magnet assembly such that the magnet assembly includes an overall length along the longitudinal axis and the voice coil includes an overall length along the longitudinal axis, wherein a halfway point of the overall length of the magnet assembly coincides with a halfway point of the overall length of the voice coil when the voice coil is at rest.

2. The loudspeaker of claim 1, wherein the first suspension element and the second suspension element place the voice coil in a balanced state such that the voice coil from the first side to the second side maintains a constant transverse spacing with the frame.

3. The loudspeaker of claim 2, wherein the first suspension element and the second suspension element placing the voice coil in the balanced state further includes maintaining a constant transverse spacing with the magnet assembly.

4. The loudspeaker of claim 1, further comprising a third suspension element attached to the voice coil former, adjacent to the first side of the voice coil, and attached to the frame for supporting the first side of the voice coil.

5. The loudspeaker of claim 4, wherein the first suspension element, the second suspension element, and the third suspension element place the voice coil in a balanced state such that the voice coil from the first side to the second side maintains a constant transverse spacing with the frame.

6. The loudspeaker of claim 5, wherein the first suspension element, the second suspension element, and the third suspension element placing the voice coil in the balanced state further includes maintaining a constant transverse spacing with the magnet assembly.

7. The loudspeaker of claim 1, wherein the symmetrical alignment between the voice coil and the magnet assembly yields at least one of:

a substantially symmetric motor force, a substantially symmetric suspension stiffness, a substantially symmetric inductance.

8. The loudspeaker of claim 1, wherein the frame includes an outer wall that encircles the magnet assembly, wherein the outer wall and the magnet assembly form the voice coil gap, wherein the outer wall includes an overall length along the longitudinal axis, wherein a halfway point of the overall length of the outer wall coincides with the halfway point of the overall length of the voice coil when the voice coil is at rest.

9. A loudspeaker comprising:

a magnet assembly aligned along a longitudinal axis;

a frame encircled around the magnet assembly, wherein the frame includes an outer wall, wherein the magnet assembly and the outer wall form a voice coil gap;

a voice coil disposed in the voice coil gap, wherein the voice coil includes a first side longitudinally spaced from a second side, and wherein the voice coil is aligned with the magnet assembly to yield at least two of:

a substantially symmetric motor force, a substantially symmetric suspension stiffness, a substantially symmetric inductance; and a first suspension element attached to the frame and adapted to apply a first stiffness to the first side of the voice coil, and a second suspension element attached to the frame and adapted to apply a second stiffness to the second side of the voice coil.

10. The loudspeaker of claim 9, wherein the first stiffness applied by the first suspension element to the first side of the voice coil is equal to the second stiffness applied by the second suspension element to the second side of the voice coil.

11. The loudspeaker of claim 9, further comprising a third suspension element attached to the frame and adapted to apply a third stiffness to the first side of the voice coil.

12. The loudspeaker of claim 11, wherein the first stiffness applied by the first suspension element plus the third stiffness applied by the third suspension element to the first side of the voice coil is equal to the second stiffness applied by the second suspension element to the second side of the voice coil.

13. The loudspeaker of claim 11, wherein the first suspension element, the second suspension element, and the third suspension element place the voice coil in a balanced state such that the voice coil from the first side to the second side maintains a constant transverse spacing with the outer wall and the voice coil from the first side to the second side maintains a constant transverse spacing with the magnet assembly.

14. The loudspeaker of claim 9, wherein the frame includes a first basket that angularly extends from the outer wall to a distal first portion, and the frame includes a second basket that angularly extends from the outer wall to a distal second portion.

15. The loudspeaker of claim 14, wherein the first suspension element is attached to the frame at the distal first portion, and the second suspension element is attached to the frame at the distal second portion.

16. The loudspeaker of claim 15, wherein the first suspension element is further attached to a diaphragm, and the diaphragm is attached to the voice coil.

17. The loudspeaker of claim 15, wherein the second suspension element is attached to the voice coil.

18. The loudspeaker of claim 14, further comprising a back plate that is attached to the magnet assembly and the distal second portion of the second basket.

19. The loudspeaker of claim 18, wherein the back plate is made out of a non-ferrous material, and the frame is made out of a ferrous material.

20. The loudspeaker of claim 9, wherein the voice coil is symmetrically aligned with the magnet assembly.

21. The loudspeaker of claim 9, wherein the first suspension element and the second suspension element place the voice coil in a balanced state such that the voice coil from the first side to the second side maintains a constant transverse spacing with the outer wall and the voice coil from the first side to the second side maintains a constant transverse spacing with the magnet assembly.

22. A loudspeaker comprising:

a magnet assembly aligned along a longitudinal axis;

a frame encircled around the magnet assembly, wherein the magnet assembly and the frame form a voice coil gap;

a voice coil disposed in the voice coil gap, wherein the voice coil includes a first side longitudinally spaced from a second side;

a first suspension region including a first suspension element attached to the frame and the first side of the voice coil; and a second suspension region including a second suspension element attached to the frame and the second side of the voice coil;

wherein the voice coil is symmetrically aligned with the magnet assembly such that the magnet assembly includes an overall length along the longitudinal axis and the voice coil includes an overall length along the longitudinal axis, wherein a halfway point of the overall length of the magnet assembly coincides with a halfway point of the overall length of the voice coil when the voice coil is at rest.

23. The loudspeaker of claim 22, wherein the symmetrical alignment yields at least one of:

a substantially symmetric motor force, a substantially symmetric suspension stiffness, a substantially symmetric inductance.

24. The loudspeaker of claim 22, wherein the frame includes an outer wall that encircles the magnet assembly, wherein the outer wall and the magnet assembly form the voice coil gap, wherein the outer wall includes an overall length along the longitudinal axis, wherein a halfway point of the overall length of the outer wall coincides with the halfway point of the overall length of the voice coil when the voice coil is at rest.

* * * * *